US005965048A

United States Patent [19]

Powers

[11] Patent Number: 5,965,048

[45] Date of Patent: Oct. 12, 1999

[54] HEATED CHAMBER INCLUDING AN OPEN WALL WITH A GAS CURTAIN

[75] Inventor: John M. Powers, Independence, Ky.

[73] Assignee: General Electric Company, Cincinnati, Ohio

[21] Appl. No.: 09/196,177

[22] Filed: Nov. 20, 1998

[51] Int. Cl.[6] ..... A21B 1/00

[52] U.S. Cl. ..... 219/411; 432/64; 219/385; 219/386

[58] Field of Search ..... 219/72, 74, 123.33, 219/385, 386, 411, 391, 392, 521; 34/201, 202, 224, 225, 227; 312/236; 432/64

[56] References Cited

U.S. PATENT DOCUMENTS

| | | | |
|---|---|---|---|
| 3,170,681 | 2/1965 | Davies | 263/40 |
| 3,575,398 | 4/1971 | Lincoln | 263/36 |
| 3,713,401 | 1/1973 | McClurkin | 107/57 B |
| 3,957,326 | 5/1976 | Molitor | 312/236 |
| 4,572,944 | 2/1986 | Ballard | 219/391 |
| 4,793,283 | 12/1988 | Saekozy | 118/725 |
| 4,898,319 | 2/1990 | Williams | 228/219 |
| 5,708,755 | 1/1998 | Gronet et al. | 392/416 |
| 5,870,526 | 2/1999 | Aschner et al. | 392/416 |

*Primary Examiner*—Philip H. Leung
*Assistant Examiner*—Shawntina Fuqua
*Attorney, Agent, or Firm*—Andrew C. Hess; Gerry S. Gressel

[57] ABSTRACT

An atmosphere controlled workpiece heating chamber includes a spaced apart multiple gas flow means combination which avoids contamination of the atmosphere within the chamber from ambient atmosphere such as air. In one form, the chamber includes a gas diffuser as one flow means, and a heating means, both of which are readily removable, and easily and accurately replaceable.

8 Claims, 3 Drawing Sheets

HEATED CHAMBER INCLUDING AN OPEN WALL WITH A GAS CURTAIN

BACKGROUND OF THE INVENTION

This invention relates to a workpiece heating chamber, and, more particularly, to a workpiece heating chamber having a controlled internal atmosphere.

Welding of certain metal articles, for example gas turbine engine components made of a high temperature Ni base superalloy, is conducted at elevated temperatures within a chamber in which the atmosphere is controlled to be non-oxidizing. Typically argon gas is used for that purpose. An operator such as a welder applies a weld metal, for example in the form of a metal rod, to a portion of the article, frequently in the repair but also in the original manufacture of the article. Associated with the chamber is a heat source such as a high temperature heat lamp capable of heating at least a portion of the workpiece and the metal rod used for welding to an appropriate temperature range.

Several problems exist with such apparatus currently in use. One is that contamination of the atmosphere within the chamber by oxygen has occurred as a result of ambient air seeping into the chamber. One area of contamination entry has been observed to be at an operator access port through which the operator works; another such area is at a joint between the heat source and a wall of the chamber. The presence of an oxidizing material such as oxygen from air can reduce weld quality, resulting in weld cracks. In addition, the presence of oxygen in such a chamber can result in poor flowablity of the weld material as well as in detrimental inclusions in the weld itself. Another problem with known apparatus relates to the accurate and reproducible alignment of the heat source, which must be replaced from time to time, with a position within the chamber at which the workpiece is held for welding. As a result of problems such as these, known chambers were unable to maintain a consistent non-oxidizing temperature condition during welding.

BRIEF SUMMARY OF THE INVENTION

The present invention, in one form, provides an atmosphere controlled workpiece heating chamber which includes an operator access port, a chamber bottom portion, means to hold the workpiece within the chamber, heating means to heat the workpiece within the chamber, and gas flow means to introduce gas into the chamber to provide a chamber atmosphere wherein the atmosphere is maintained by a combination of gas flow means. A first gas flow means introduces gas into the chamber at the chamber bottom portion through a gas diffuser member disposed substantially across the chamber bottom portion. A second gas flow means, spaced apart from the first gas flow means at the operator access port, directs a curtain of gas generally across the operator access port.

DETAILED DESCRIPTION OF THE INVENTION

One form of the present invention provides an atmosphere controlled workpiece heating chamber with the atmosphere, typically non-oxidizing, maintained through a combination of first and second gas flow means. A first is at a bottom portion of the chamber; a second provides a curtain of gas directed generally across an operator access port. Other forms of the invention combine with the spaced apart multipart gas flow, when a radiant type of heat source directs heat into the chamber through a substantially transparent window, a combination gas seal and heat source locating means at the window.

Figure 1:
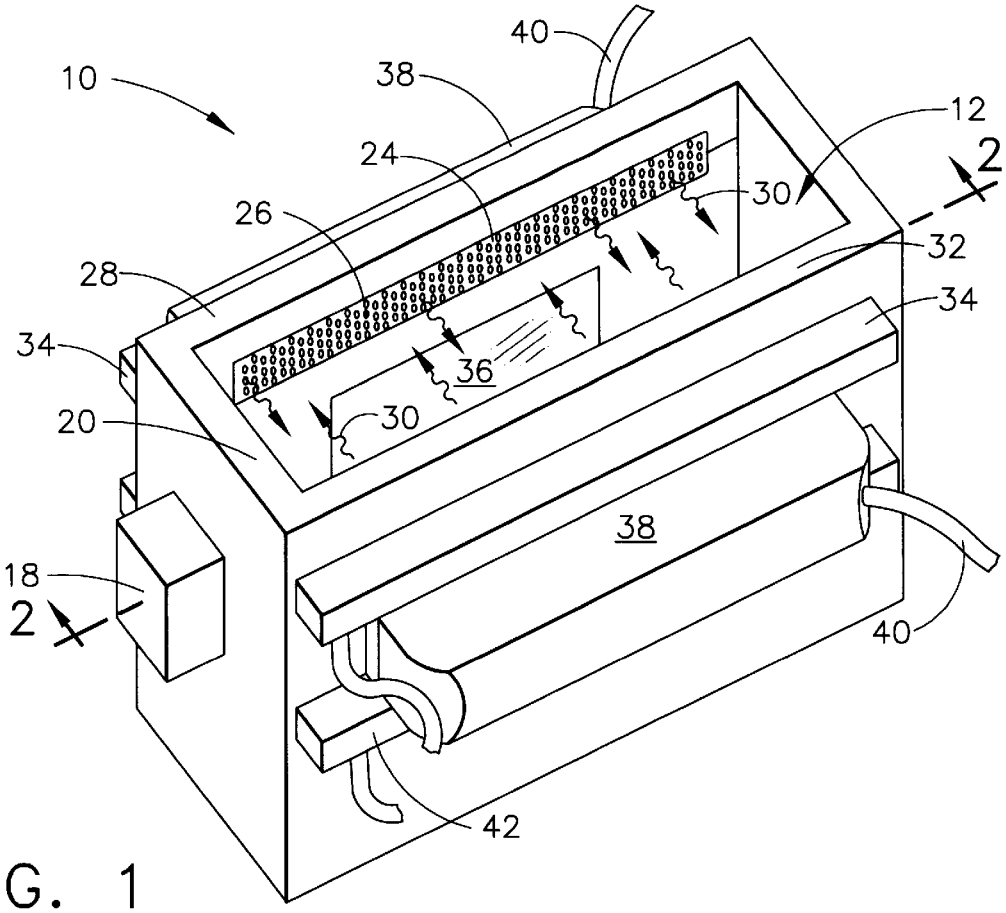
FIG. 1 is a diagrammatic perspective view of a chamber according to the present invention.
Figure 2:
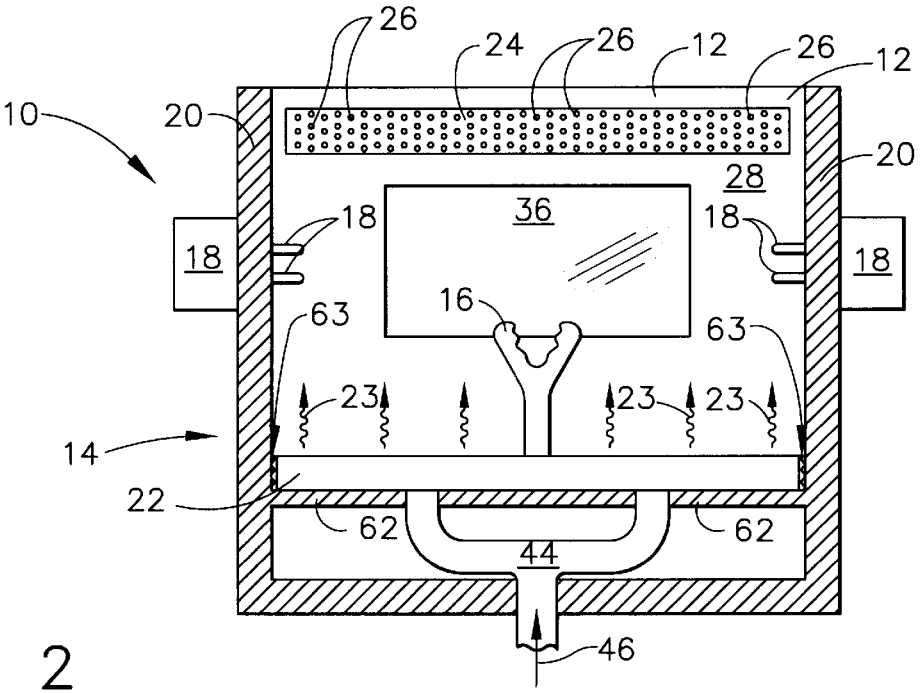
FIG. 2 is a sectional view of the chamber of FIG. 1 taken along lines 2—2.

The present invention will be more fully understood by reference to the drawings in which FIG. 1 is a diagrammatic perspective view of one form of the present invention, and FIG. 2 is a sectional view of FIG. 1 taken along lines 2—2.

The atmosphere controlled workpiece heating chamber shown generally at 10 includes an operator access port 12, and a chamber bottom portion shown generally at 14 in FIG. 2. Within chamber 10 is a combination workpiece support means represented by a first workpiece support means 16, shown in the form of a turbine engine blade dovetail support to hold and rotate a blade substantially vertically, and a second workpiece support means shown diagrammatically at 18 to hold and rotate a blade substantially about a horizontal axis, carried by opposing side walls 20 of the chamber. Such a workpiece support combination provides the chamber with added flexibility in supporting a workpiece in an appropriate welding position in respect to a heating source, such as a heat lamp.

Atmosphere, for example argon gas, is maintained within chamber 10, at least in part, by first gas flow means 22 in the form of a gas diffuser member disposed at chamber bottom portion 14 substantially across the chamber bottom portion and carrying first workpiece support means 16. First gas flow means 22 introduces atmosphere gas into chamber 10, as shown by flow arrows 23 in FIG. 2 as well as in FIG. 5. Combined in operation with first gas flow means 22 is second gas flow means 24 in the form of spaced apart gas inlet openings 26 in chamber wall 28 at, i.e. in the vicinity of, operator access port 12 to direct gas flow, shown by flow arrows 30 in FIG. 1, in a curtain generally across operator access port 12. Shown in the form of FIG. 1, spaced apart openings 26 are disposed in opposing chamber walls 28 and 30 to direct gas flow 30 from at least generally opposing sides of the access port. Atmosphere gas such as argon is supplied to openings 26 from an atmosphere gas manifold 34 to which openings 26 are connected. In FIG. 1, a pair of protruding gas manifolds is provided, one for each of walls 28 and 30. From the combination of the first and second gas flow means 22 and 24, atmosphere within chamber 10 is maintained by the described combination of positive atmosphere gas flow while an operator conducts operations, for example welding, within the chamber through access port 12.

Provided in walls 28 and 30 of chamber 10, in the form shown in FIG. 1, is a pair of windows 36 to allow heat waves from a heating means 38, such as a high temperature quartz halogen lamp, to be introduced into chamber 10. The heating means heats a workpiece, not shown, supported by workpiece support means 16 or 18, depending upon the portion of the workpiece to be treated. Electrical power to heating means 38 is provided in the usual manner such as through electrical connections to a powers source diagrammatically represented by wires 40. Also provided within or associated with walls of the chamber are fluid cooling jacket, coils or channels, for example for water cooling, supplied from cooling fluid manifold 42.

Figure 4:
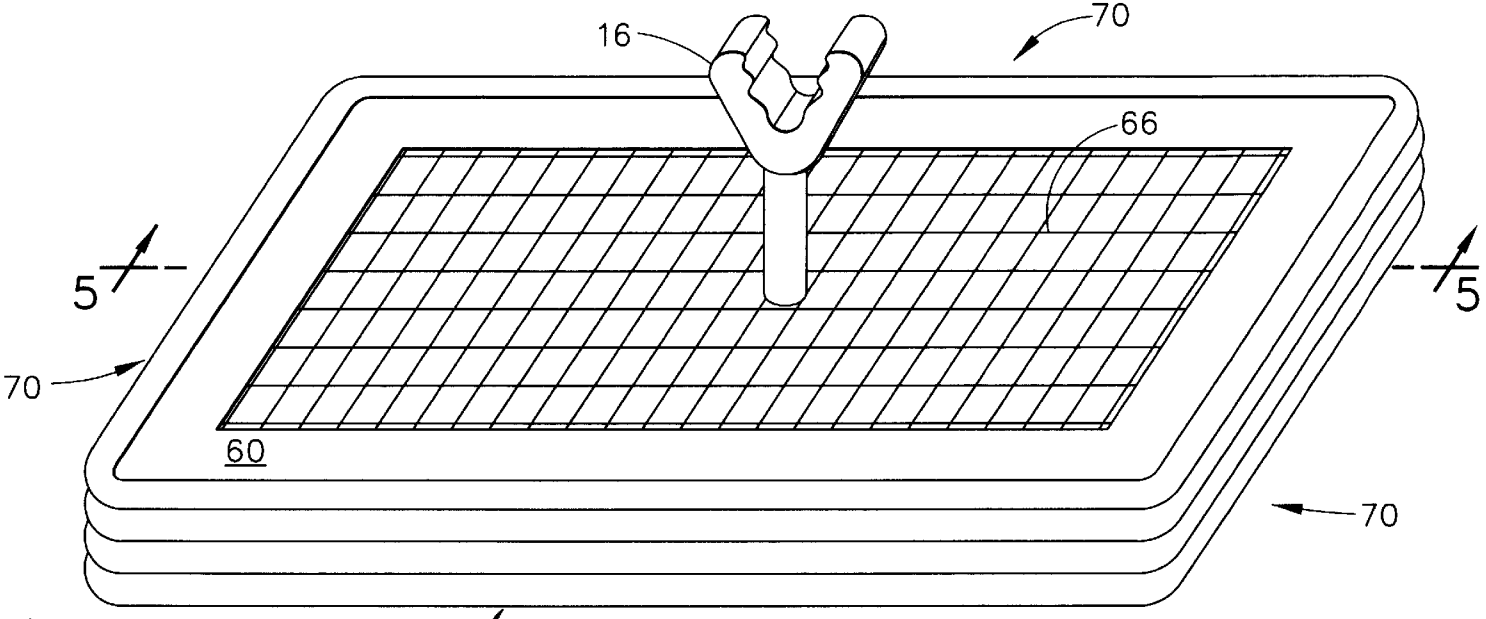
FIG. 4 is a perspective view of one form of a gas diffuser member and workpiece holder combination as shown in FIG. 2.
Figure 5:
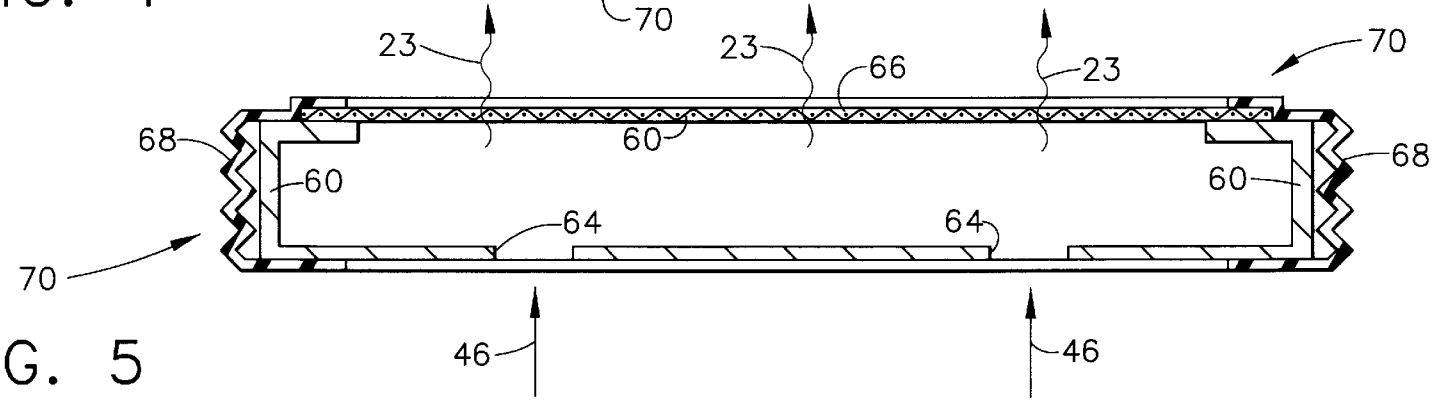
FIG. 5 is a sectional view of the gas diffuser of FIG. 4 taken along lines 5—5.

As shown in FIG. 2, first gas flow means 22 is in the form of a gas diffuser, one form of which is shown in more detail in FIGS. 4 and 5, disposed at chamber bottom portion 14. First gas flow means 22 is connected, such as through conduit 44 to a gas source represented by arrow 46, for example argon gas under pressure.

As was mentioned above, problems associated with use of known forms of workpiece heating chambers include the problem of leakage of ambient oxidizing atmosphere into the chamber from windows, such as 36 in the drawings, and the problem of the accurate relocation of a heating means initially and/or when replacement of the heating means is required. Forms of the present invention provide a seal to avoid such leakage and a combination of such seal with accurate location of the heating means at window 36. One such arrangement is shown in the fragmentary exploded sectional view of FIG. 3.

Figure 3:
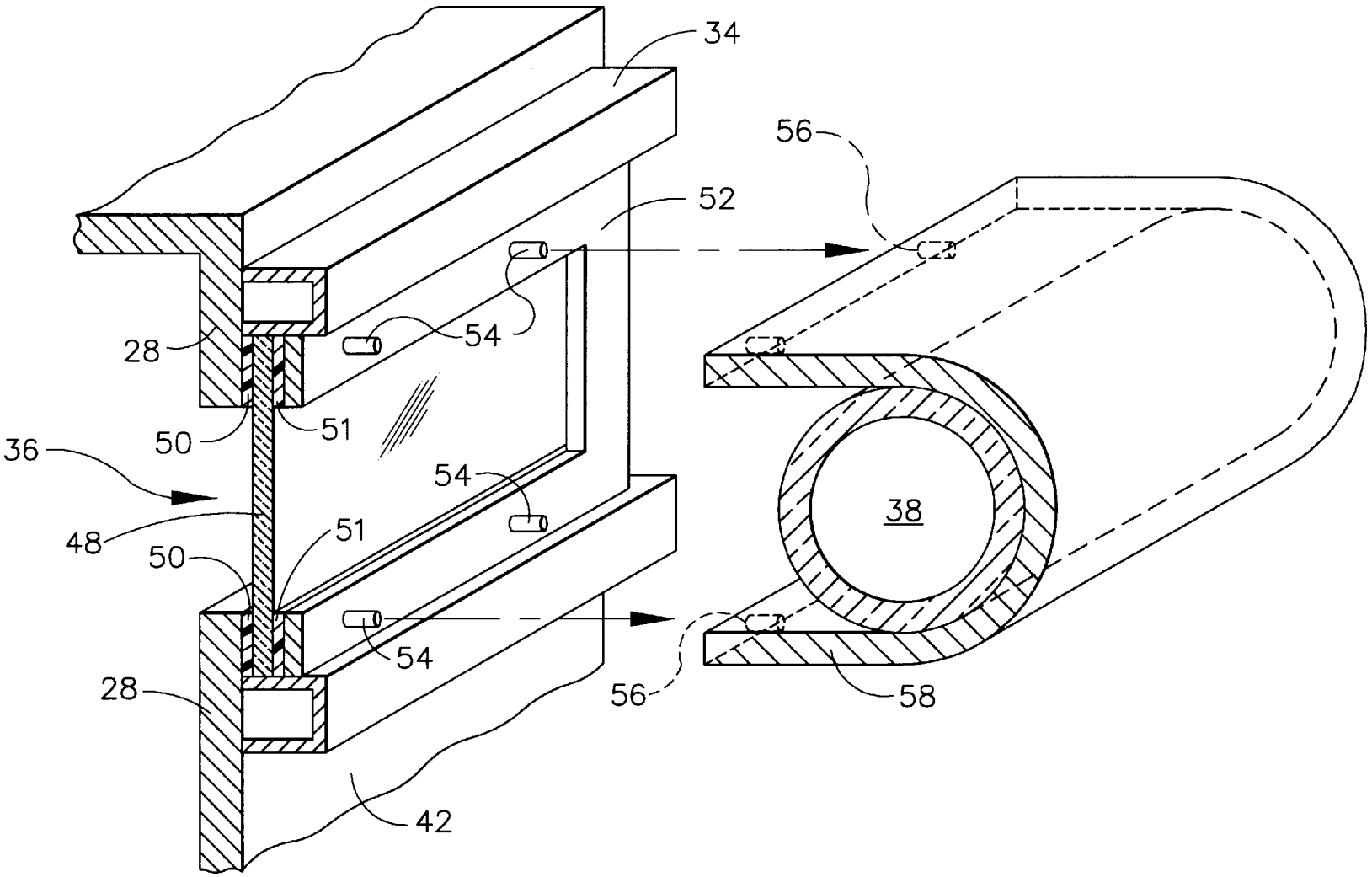
FIG. 3 is a fragmentary, exploded sectional view of the window in FIG. 2 through which heat is introduced into the chamber and the alignment and assembly of a heat lamp with the window.

In the embodiment of FIG. 3, the above described chamber 10 includes through wall 28 a window 36 across which is sealed a heat resistant substantially transparent member 48, for example a sheet of quartz material. As used herein, the term "transparent" in respect to such a member as 48 means transparent to heat rays such as would emanate from a heat lamp. To provide a gas seal about member 48, a pair of heat resistant gaskets 50 and 51, such as of a glass fiber material, are disposed on both sides of member 48 as shown. Associated with window 36 and member 48 is a heating means 38, for heating a workpiece within chamber 10 In FIG. 3, such heating means is shown in the form of a high temperature heat lamp, one type of which is a 2000 watt quartz halogen lamp combined with an elliptical mirror to focus heat rays within chamber 10.

As was mentioned above, accurate location as well as rapid release and relocation upon replacement of heating means 38 has presented a problem in known apparatus. A form of the present invention provides an accurate, easily releasable locating combination for heating means 38 in respect to window 36 and the wall, for example wall 28, through which the window penetrates. Such a combination is shown in FIG. 3 as a substantially rigid heat resistant gasket plate 52, such as of a stainless steel, secured with wall 28. Gasket plate 52 is sized to fit between protruding atmosphere gas manifold 34 and protruding cooling fluid manifold 42, both of which function in combination as locating members as well as manifolds. Gasket plate 52 includes a plurality of spaced apart locating protrusions 54, shown in the form of protruding pins carried by gasket plate 52. Protrusions 54 are located about gasket plate 52 to match the location of a pattern of locating indentations 56 in lamp housing 58 which carries heating means 38. With gasket plate 52 secured with wall 28 between manifolds 34 and 42, such as by bolting, a heating means can be located and secured accurately at window 36 through the combination of matched protrusions 54 and indentations 56. Similarly, the heating means can be removed easily and accurately replaced. In addition, the relatively wide surface of rigid gasket plate 52 in combination with lamp housing 58 provides more locating surface area than does a smaller edge of a lamp seal used in known apparatus. Also, transparent member 48 and heat resistant gaskets 50 and 51 are sized to fit between manifolds 34 and 42.

FIG. 2 shows first gas flow means 22 to be removably supported across chamber bottom portion 14. That form is shown in more detail in the perspective view of FIG. 4 and in the sectional view of FIG. 5 taken along lines 5—5 of FIG. 4. First gas flow means or diffuser 22 includes a substantially rigid support member 60, such as of stainless steel, shaped to fit closely within chamber bottom portion 14 of chamber 10 across a small gap 63 with the chamber walls such as 20, 28 and 32, FIG. 2. In the embodiment shown in FIG. 2, diffuser 22 is supported by shelf 62 which is secured with or a part of such walls of the chamber. A plurality of openings 64 through support member 60 are connected, for example through conduit 44, with a supply of atmosphere gas such as argon represented by flow arrows 46. Secured across a portion of support member 60, as shown in FIGS. 4 and 5, is a gas porous layer 66, conveniently in one form as a wire mesh layer or screen, to enable gas flow 23 to be distributed into chamber 10. Removable diffuser 22 in FIGS. 4 and 5 includes a high temperature flexible gas seal 68, which bridges gap 63. One form of flexible gas seal 68 is a silicone impregnated Teflon material rolled and bonded around the peripheral rim 70 of diffuser 22 and over the edges of gas porous layer or screen 66, as shown in more detail in FIG. 5. In such form, diffuser 22 is releasably gas sealed within chamber 1 and easily removable therefrom for replacement, as required.

The present invention provides an atmosphere controlled workpiece heating chamber with a spaced apart multiple gas flow means combination which avoids contamination of the atmosphere within the chamber from ambient atmosphere such as air. In addition, forms of the invention include a gas diffuser and heating means which are readily removable and easily and accurately replaceable. The present invention has been described in connection with specific examples and embodiments which are intended to be typical of rather than in any way limiting on its scope. Those skilled in the pertinent arts will understand that the invention is capable of variations and modifications without departing from the scope of the appended claims.

I claim:

1. An atmosphere controlled workpiece heating chamber which includes an operator access port, a chamber bottom portion spaced apart from the access port by a side wall, means to hold a workpiece within the chamber, heating means to heat the workpiece within the chamber, and an access port gas flow means to introduce gas into the chamber at the operator access port to direct a curtain of gas generally across the access port to provide a chamber atmosphere, wherein:

the chamber atmosphere is maintained by a combination of distinct, spaced apart gas flow means comprising:

a) a first gas flow means to introduce the gas into the chamber through the chamber bottom portion; and, b) the access port gas flow means at the operator access port is spaced apart from the first gas flow means by the side wall.

2. The chamber of claim 1 in which the first gas flow means is a gas diffuser member disposed substantially across the chamber bottom portion.

3. The chamber of claim 2 in which the gas diffuser member:

is removably supported across the chamber bottom portion and is in contact with walls of the bottom portion at a peripheral rim of the diffuser member; and, the peripheral rim carries a flexible gas seal about the peripheral rim for registry with walls of the bottom portion to provide a gas seal there between.

4. The chamber of claim 3 in which the gas diffuser member includes means to support the workpiece.

5. The chamber of claim 1 which includes multiple means to support the workpiece comprising:

a first workpiece support means carried by the first gas flow means to support the workpiece generally vertically within the chamber; and, a second workpiece support means carried by a wall of the chamber to support the workpiece generally horizontally within the chamber.

6. The chamber of claim 5 in which the second workpiece support means is rotatable generally about a horizontal axis.

7. The chamber of claim 1 in which the heating means to heat the workpiece within the chamber is a focused heat lamp removably carried by a wall of the chamber at a window there through, the window including there across a heat resistant substantially transparent member disposed between the heat lamp and the chamber to allow heat waves from the heat lamp to enter the chamber, wherein:

the heat lamp includes a lamp housing having a plurality of locating indentations therein; and, the transparent member and the heat lamp carried by the wall of the chamber are releasably positioned at the window through the combination of:

a) a pair of spaced apart manifold members, one carried by and protruding from the wall of the chamber on one side of the window and one carried by and protruding from the wall of the chamber on another side of the window, the transparent member being sized to fit between the manifold members; and, b) a substantially rigid heat resistant gasket plate disposed between the transparent member and the heat lamp, the gasket plate being sized to fit between the manifold members and carrying a plurality of spaced apart locating protrusions disposed about the gasket plate to match locating indentations in the lamp housing.

8. The chamber of claim 7 wherein:

the transparent member is sealed at the window with a gas seal which is a combination of:

a) a first heat resistant gasket about the window between the wall and the transparent member; and, b) a second heat resistant gasket about the transparent member between the transparent member and the gasket plate.

* * * * *